US007981018B2

(12) United States Patent
Himmelstoss

(10) Patent No.: US 7,981,018 B2
(45) Date of Patent: Jul. 19, 2011

(54) FOLDING SUPERSTRUCTURE IN A WEB-FED ROTARY PRINTING PRESS AND METHOD FOR OPERATING THE SAME

(75) Inventor: Peter Himmelstoss, Mering (DE)

(73) Assignee: manroland AG, Offenbach am Main (DE)

( * ) Notice: Subject to any disclaimer, the term of this patent is extended or adjusted under 35 U.S.C. 154(b) by 178 days.

(21) Appl. No.: 12/394,556

(22) Filed: Feb. 27, 2009

(65) Prior Publication Data

US 2009/0221410 A1 Sep. 3, 2009

(30) Foreign Application Priority Data

Feb. 29, 2008 (DE) ..... 10 2008 012 034

(51) Int. Cl.
*B31B 1/14* (2006.01)

(52) U.S. Cl. ..... 493/359; 493/397; 493/401; 493/410; 493/454; 270/5.01; 270/20.1

(58) Field of Classification Search ..... 493/359, 493/397, 362, 401, 405, 410, 454; 270/5.01, 270/5.02, 20.1
See application file for complete search history.

(56) References Cited

U.S. PATENT DOCUMENTS

| | | | | |
|---|---|---|---|---|
| 2,449,234 | A | 9/1948 | Knoble et al. | |
| 5,439,206 | A * | 8/1995 | Raasch et al. | 270/8 |
| 5,527,256 | A * | 6/1996 | Vauchelle et al. | 493/424 |
| 5,904,312 | A | 5/1999 | Hinz et al. | |
| 6,338,707 | B1 * | 1/2002 | Michalik | 493/357 |
| 6,941,862 | B2 * | 9/2005 | Weiler | 101/227 |
| 2008/0001339 | A1 * | 1/2008 | Tahara | 270/41 |

FOREIGN PATENT DOCUMENTS

| | | |
|---|---|---|
| DE | 101 63 211 | 7/2003 |
| EP | 0 890 538 | 1/1999 |
| JP | 04 075967 | 3/1992 |

* cited by examiner

*Primary Examiner* — Hemant M Desai
(74) *Attorney, Agent, or Firm* — Cohen Pontani Lieberman & Pavane LLP

(57) ABSTRACT

A folding superstructure and to a method for operating a folding superstructure of a web-fed rotary printing press with at least one former by which one or more paper webs fed through this former are provided with a longitudinal fold. The longitudinally folded paper web is guided to folding cylinders. The folding cylinders further process the uncut paper web to form cut sheets. The still uncut paper web is actively transported by at least one transporting device.

18 Claims, 2 Drawing Sheets

FOLDING SUPERSTRUCTURE IN A WEB-FED ROTARY PRINTING PRESS AND METHOD FOR OPERATING THE SAME

BACKGROUND OF THE INVENTION

1. Field of the Invention

The invention is directed to a folding superstructure of a web-fed rotary printing press with at least one former by which one or more paper webs fed through this former are provided with a longitudinal fold, the longitudinally folded paper web being actively guided to folding cylinders, wherein the folding cylinders further process the uncut paper web to form cut sheets.

The invention is further directed to a method for operating a folding superstructure of a web-fed rotary printing press, one or more paper webs being guided through at least one former and longitudinally folded, and the longitudinally folded paper web is actively guided to folding cylinders, wherein the folding cylinders cut the uncut paper web at least to form sheets.

2. Description of Related Art

In web-fed rotary printing presses, which can be constructed as offset printing presses in newspaper printing and picture printing, a paper web is fed to a printing unit or a plurality of printing units and is imprinted in the latter with one or more colors. The printed paper web is fed as an individual strand which is divided into partial strands, to one or more formers where each of the strands acquires a longitudinal fold therein.

In a typical folding superstructure, adjoining a former nose 2 of the one or more formers 1 are former lead-in rollers 3, 4, which form a lead-in gap 5. Generally, a pair of nipping rollers 7, 8 is arranged after the former lead-in rollers 3,4 for actively advancing the paper web 6. After the one or more formers, further processing is carried out in a folding apparatus or folding unit.

Traditionally, guide plates 9 or fingers have been used to feed the uncut paper web 6 to different sides of the folding unit. The paper web 6 is guided by one or more the surfaces of the guide plate or finger 9. An operator must adjust or manipulate the folding unit in order to change the feed side of the folding unit. This construction makes operation inconvenient and laborious when feeding in the paper web 6.

SUMMARY OF THE INVENTION

An object of the present invention is to provide an improved folding superstructure in a web-fed rotary printing press.

This object is met by a folding superstructure that includes a transport device that actively moves the folded web.

It is advantageous to employ a dynamically acting transporting device, preferably a transporting belt, instead of the formerly used statically acting guide plates or fingers by which the uncut web was passively guided to different sides of the folding apparatus, e.g., for left-hand or right-hand delivery.

According to one embodiment, a folding superstructure of a web-fed rotary printing press includes at least one former by which one or more paper webs guided through this former are provided with a longitudinal fold. The longitudinally folded paper web is fed by at least one transporting device which actively moves the uncut paper web, to folding cylinders for further processing of the uncut paper web to form cut sheets, The uncut paper web is actively moved to a desired side of a folding apparatus or the like by the transporting device without laborious manipulation of the folding superstructure. This lightens the workload of the operator of the printing press because the paper web is automatically conveyed outward in relation to an extension of the former nose.

In one embodiment, at least one transporting device is arranged after a former nose of a former and in front of the folding cylinders of the folding superstructure. Further, the at least one transporting device is arranged after a pair of nipping rollers, which are arranged after the former, and in front of the folding cylinders of the folding superstructure.

In a preferred embodiment, the transporting device is constructed as a transporting belt. The construction of the transporting belt is carried out similar to the transporting belts at the belt delivery following a delivery fan.

The transporting belt preferably comprises at least two rotating shafts, and one or more belts being arranged on the shafts. The belts are arranged on the shafts at a distance from one another. The distance from the transporting device to the former nose is preferably adjustable.

In one embodiment, the former lead-in rollers arranged after the former nose are provided with at least one drive unit.

The drive can reinforce the transporting of the paper web when feeding in the paper web, commonly referred to as "webbing up" the printing press. This eliminates the manual effort expended in feeding in the paper web. In a preferred embodiment, at least one of the former lead-in rollers is driven. The operator can dedicate himself exclusively to feeding the paper webs into the former. This makes operation more convenient. The feed-in function becomes faster and more efficient.

In an advantageous embodiment of the invention, each of two former lead-in rollers is provided with at least one drive unit. In this way, the paper webs, which are longitudinally folded following the former, are actively conveyed through the feed-in gap.

In another embodiment, the drive unit is constructed such that it can be switched on at least during the feeding in of the paper web and can be switched off during printing operation of the web-fed rotary printing press.

A method for operating a folding superstructure of a web-fed rotary printing press, wherein one or more paper webs, fed via at least one former, are longitudinally folded. The longitudinally folded paper web is fed to folding cylinders, wherein the folding cylinders cut the uncut paper web at least to form sheets, wherein the still uncut paper web is actively conveyed via at least one transporting device.

Using the transporting device the still uncut paper web is actively moved to the folding apparatus on a desired side, for example, for a left-hand or right-hand delivery, without laborious manipulation of the folding superstructure. This lightens the workload of the operator of the printing press when feeding in the paper web, because the paper web is automatically conveyed outward in relation to an extension of the former nose.

In a preferred embodiment, the still uncut paper web is moved in a direction virtually perpendicular to a plane between the former nose and folding cylinders after the former nose of the former and before the folding cylinders of the folding superstructure. In this way, the paper web can be moved simply and automatically to the right-hand side or to the left-hand side of the folding superstructure.

In another embodiment, the uncut paper web is moved after a pair of nipping rollers and before the folding cylinders of the folding superstructure in a direction virtually perpendicular to a plane between the former nose and folding cylinders.

The uncut paper web is preferably moved by a transporting belt. The transporting belt is constructed similar to the transporting belts at the belt delivery after the delivery fan so that standard components can be used.

In one embodiment of the invention, the uncut paper web is conveyed by means of at least two rotating shafts, wherein one or more belts are arranged on the shafts.

The distance between one end of the transporting device toward the former nose and the other end of the transporting device is adjustable. In this way, the guide angle of the paper web can be adjusted.

In one embodiment, former lead-in rollers are arranged after the former nose and are driven by a drive unit.

The drive unit can reinforce the transporting of the paper web through the former lead-in rollers when feeding in the paper web, that is, when "webbing up" the printing press. This dispenses with the manual effort expended in feeding in the paper web. If necessary, the drive unit can also be switched on during printing operation so that the former lead-in rollers likewise function as a pair of nipping rollers.

BRIEF DESCRIPTION OF DRAWINGS

Preferred further developments of the invention are indicated in the following description. An embodiment example of the invention is described more fully with reference to the two drawings, although the invention is not limited to this embodiment form.

DETAILED DESCRIPTION OF PREFERRED EMBODIMENTS

Figure 1:
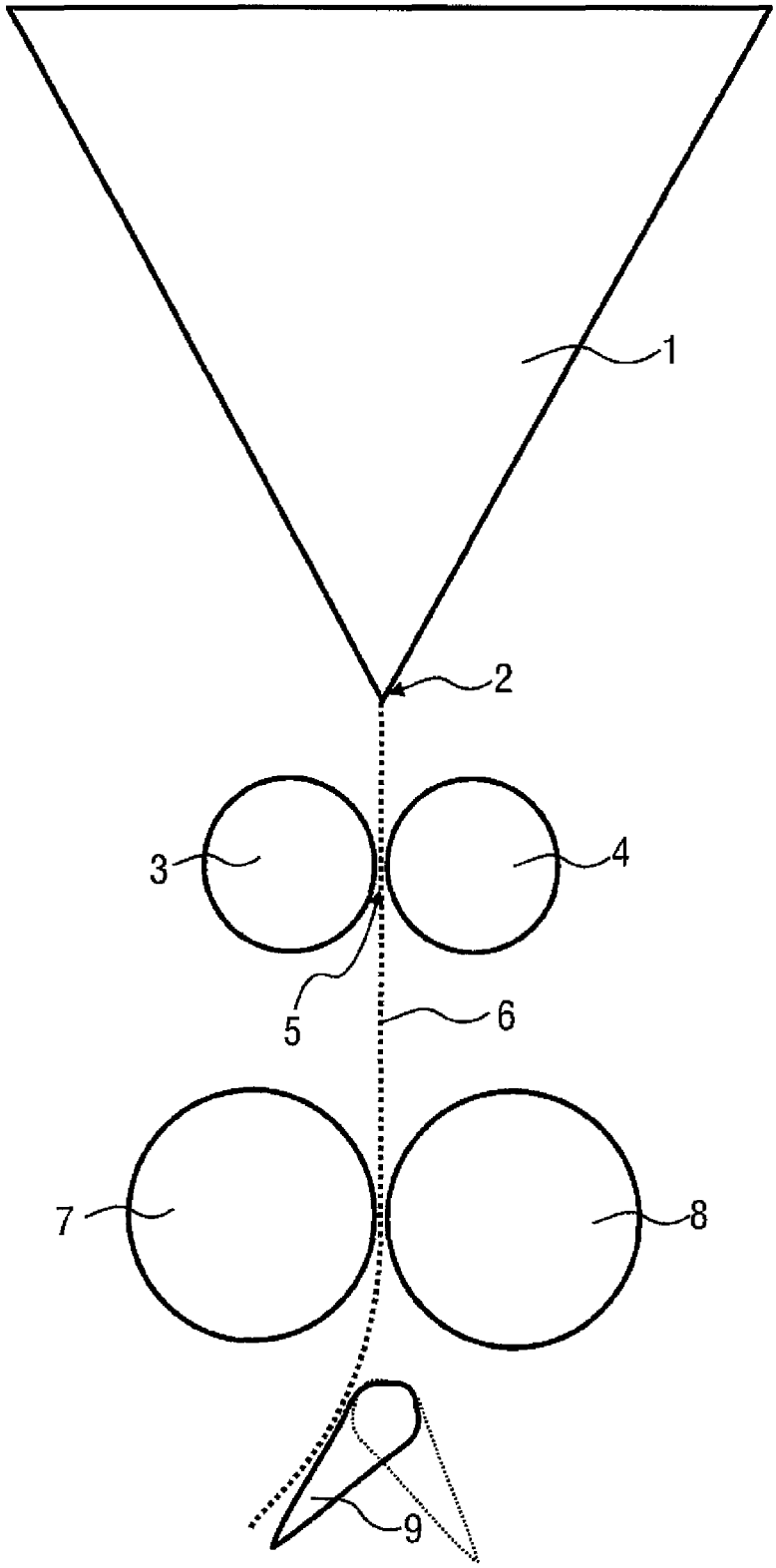
FIG 1 Prior Art
FIG. 1 is a schematic depiction of a section of a known folding superstructure.

FIG. 1 depicts a section of a known folding superstructure of a rotary offset printing press. This folding superstructure includes a former 1 by which a paper web or a plurality of paper web strands guided via the former 1 are provided with a longitudinal fold. There are generally two printed pages on the one or more paper web strand portions.

For example, in a six newspaper page-width printing press (e.g., 6-2) or an eight newspaper page-width printing press (e.g., 8-2 or 8-3), three or four formers 1 of the kind mentioned above are typically arranged side-by-side. The one or more paper web portions are accordingly guided over the former 1 and are provided with a longitudinal fold below the former nose 2. In FIG. 1, the longitudinally folded paper web is designated by 6.

The two former lead-in rollers 3 and 4, which form a lead-in gap 5, follow the former nose 2 of the former 1. The main function of the former lead-in rollers 3 and 4 is to reinforce the former 1 in making the longitudinal fold.

The longitudinally folded paper web 6 is actively fed to the folding unit by means of the two nipping rollers 7 and 8. The folding unit is not shown in FIG. 1.

Guide plates 9, also known as fingers, typically move the longitudinally folded paper web 6 to different sides. The guide plate 9 deflects the paper web 6 to the left as shown in FIG. 1. The guide plate indicated by a dashed line in FIG. 1 would deflect the paper web 6 to the right. The adjustment of the guide plates 9 requires the operator to manipulate the folder superstructure.

After the paper web 6 is folded in the folding unit in addition to the longitudinal fold and then cut, the individual folded and cut sheets are transferred to a transporting belt at the belt delivery by a delivery fan.

Figure 2:
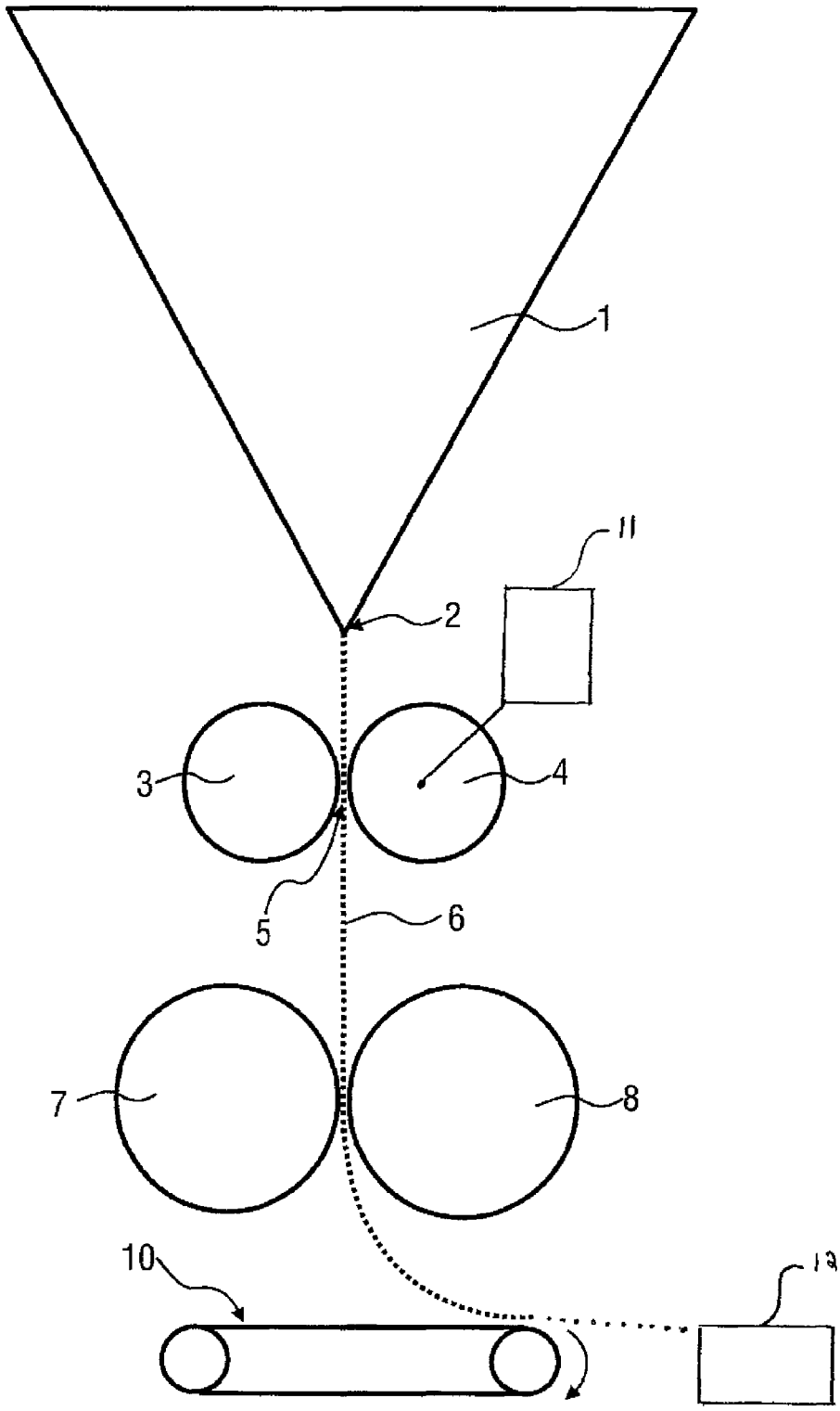
FIG. 2 is a schematic depiction of folding superstructure with a web transporting device.

FIG. 2 depicts a novel folding superstructure including a web transporting device 10. The folding superstructure is similar to the folding superstructure shown in FIG. 1 and also comprises at least one former 1 by which a paper web strand or a plurality of paper web strands which are guided via the former 1 are provided with a longitudinal fold.

The two former lead-in rollers 3 and 4, which form a lead-in gap 5, follow the former nose 2 of the former 1. The main function of the former lead-in rollers 3 and 4 is to reinforce the former 1 in making the longitudinal fold. The former lead-in rollers 3 and 4 are outfitted with a drive unit 11, to facilitate the feeding in of paper web 6.

The longitudinally folded paper web 6 is actively fed to the folding unit by two nipping rollers 7 and 8. The folding unit is not shown.

In contrast to the construction in FIG. 1, no statically working guide plate 9 is used to move the longitudinally folded paper web 6 to different sides. A transporting belt 10 which rotates in clockwise direction with reference to FIG. 2, is used below the nipping rollers 7 and 8 to convey the paper web 6 to the right-hand side. When the transporting belt 10 rotates in counterclockwise direction, the paper web 6 can be conveyed to the left-hand side.

After the paper web has been folded in the folding-unit 12, in addition to the longitudinal fold and then cut, the individual sheets are transferred to a transporting belt at the belt delivery by a delivery fan.

The transporting belt at the belt delivery which transports the already cut sheets should not be confused with the transporting belt 10. Transporting belt 10 conveys the still uncut paper web 6, not the sheets that have already been finished.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A folding superstructure of a web-fed rotary printing press, the folding superstructure comprising:

at least one former configured to provide a longitudinal fold to one or more paper webs which are fed through the at least one former;

at least one folding cylinder configured to process the one or more longitudinally folded paper webs to form cut sheets; and at least one active transporting device configured to actively move the one or more longitudinally folded paper webs from the at least one former to the at least one folding cylinders, wherein the at least one active transporting device is constructed as a transporting belt.

2. The folding superstructure according to claim 1, further comprising a former nose of the at least one former, wherein the at least one active transporting device is arranged after the former nose and before the folding cylinders in a direction of movement of the one or more paper webs.

3. The folding superstructure according to claim 2, further comprising:

a pair of lead-in rollers arranged after the former nose in the direction of movement of the one or more paper webs; and at least one drive unit configured to drive at least one lead-in roller of the pair of lead-in rollers.

4. The folding superstructure according to claim 3, wherein the drive unit is further configured to be activated during a feeding-in operation and deactivated during a printing operation.

5. The folding superstructure according to claim 2, wherein the transporting belt is configured to be changeable in rotational direction and so that the one or more paper webs move substantially perpendicular to a plane between the former nose and the folding cylinder.

6. The folding superstructure according to claim 1, further comprising a pair of nipping rollers, the nipping rollers arranged after the former and before the folding cylinders in a direction of movement of the one or more paper webs, wherein the at least one active transporting device is arranged after the pair of nipping rollers.

7. The folding superstructure according to claim 1, wherein the at least one active transporting device further comprises at least two rotating shafts and the transport belt arranged on the at least two rotating shafts.

8. The folding superstructure according to claim 7, wherein a distance from the at least two rotating shafts to the former nose is adjustable.

9. The folding superstructure according to claim 1, wherein the transporting belt is configured to transport the one or more paper webs in one of a first and a second direction.

10. The folding superstructure according to claim 9, wherein the one or more paper webs move substantially perpendicular to a plane between the former nose and the folding cylinder.

11. The folding superstructure according to claim 1, wherein the transporting belt is configured to be changeable in rotational direction.

12. A method for operating a folding superstructure of a web-fed rotary printing press, comprising:

feeding one or more paper webs through at least one former to longitudinally fold the one or more paper webs;

actively conveying the one or more paper webs to a folding cylinder by at least one active transporting device, wherein a transporting belt performs the actively conveying; and cutting the one or more paper webs by one or more folding cylinders to form sheets.

13. The method according to claim 12, wherein the actively conveying of the one or more paper webs further comprises moving the one or more paper webs in a direction virtually perpendicular to a plane between a former nose of the former and the folding cylinders.

14. The method according to claim 13, further comprising changing a distance between at least one of a first end of the transporting device and the former nose and a second end of the transporting device and the former nose.

15. The method according to claim 12, wherein the actively conveying of the one or more paper webs further comprises moving the one or more paper webs in a direction virtually perpendicular to a plane between a former nose of the former and the folding cylinders after a pair of nipping rollers and before the folding cylinders in a direction of movement of the one or more paper webs.

16. The method according to claim 12, wherein the transporting is performed by at least two rotating shafts and the transporting belt is arranged on the at least two rotating shafts.

17. The method according to claim 12, further comprising driving a pair of lead-in rollers are arranged after the former nose in a direction of movement of the one or more paper webs.

18. The method according to claim 12, wherein the at least one active transporting device is configured to transport the one or more paper webs in one of a first and a second direction.

* * * * *